United States Patent [19]

Kraals

[11] 4,270,672

[45] Jun. 2, 1981

[54] DISPENSING HOLDER FOR A COLLAPSIBLE TUBE

[76] Inventor: Ralph Kraals, 551 Evergreen Dr., Pasadena, Calif. 91105

[21] Appl. No.: 60,957

[22] Filed: Jul. 26, 1979

[51] Int. Cl.[3] ..... B65D 35/28

[52] U.S. Cl. ..... 222/95; 222/103

[58] Field of Search ..... 222/95, 101, 103, 105, 222/102

[56] References Cited

U.S. PATENT DOCUMENTS

| | | | |
|---|---|---|---|
| 1,433,167 | 10/1922 | Worden . | |
| 1,450,055 | 3/1923 | Trumbull . | |
| 1,992,442 | 2/1935 | Revelle | 222/105 |
| 2,124,907 | 7/1938 | Bunting | 222/101 X |
| 2,340,681 | 2/1944 | Oursler | 222/103 X |
| 2,357,544 | 9/1944 | Prance . | |
| 2,880,911 | 4/1959 | Robertson | 222/105 |
| 3,326,420 | 6/1967 | Turner . | |
| 3,384,271 | 5/1968 | Gronwald . | |

FOREIGN PATENT DOCUMENTS

| | | | |
|---|---|---|---|
| 1112767 | 3/1956 | France | 222/105 |
| 578402 | 6/1946 | United Kingdom | 222/103 |

*Primary Examiner*—David A. Scherbel

*Attorney, Agent, or Firm*—Nilsson, Robbins, Dalgarn, Berliner, Carson & Wurst

[57] ABSTRACT

A dispensing holder for a collapsible tube, such as a tube of toothpaste, comprising a carrier plate for the tube and a seat extending substantially normal to the front of the carrier plate. The carrier plate is formed with a recessed front portion connected to the seat. The seat and carrier plate define a continuous aperture extending across their connection, formed so that the conical front end of a collapsible tube can be received through the seat and, when the tube is near empty, can be pivoted downwardly through the connection to be received in the recess and through the carrier plate, thereby facilitating emptying of the tube. A compressor having a rounded leading edge is slidably engaged to the carrier plate to provide a means for progressively collapsing the tube.

13 Claims, 4 Drawing Figures

DISPENSING HOLDER FOR A COLLAPSIBLE TUBE

FIELD OF THE INVENTION

The field of art to which the invention pertains includes the field of dispensing holders for collapsible tubes.

BACKGROUND AND SUMMARY OF THE INVENTION

A wide variety of devices have been suggested and provided for the purpose of holding a collapsible tube, such as a tube of toothpaste, and progressively dispensing the contents. These devices range from a simple slotted key, to ceramic rollers, to elaborate geared contraptions. The devices that are closest in structure to the present invention generally operate with a channel receiving a tube of toothpaste or the like with some means for rest support and progressive dispensing of the contents of the tube. For example, in Turner U.S. Pat. No. 3,326,420, the tube is secured within a channel by means of its flat end and a slide progressively engages the tube to empty its contents. In Oursler U.S. Pat. No. 2,340,681, a convex carrier plate supports a tube against a seat in the form of a plate formed with an aperture through which the neck of the tube extends. Here too, a slide of some form is used to progressively empty the contents of the tube.

Both of these devices suffer a similar drawback, that is the tube is compressed until a point adjacent its conically shaped end wherein a quantity of material remains trapped at that end. Such devices are generally not capable of further squeezing the tube to expel the last material contained in the conical end. One therefore has to insert his fingers into the device to further squeeze the remaining material out of the tube. Robertson U.S. Pat. No. 2,880,911 attempts to overcome this drawback by providing a seat having an elongated aperture and a bent section, but the aperture does not extend through the bend. The conical end of the tube can be forced down into a recess created by the bent section and the tube emptied of its contents. However, the Robertson device requires that one use his fingers to empty the contents and even if one were to attach a slide to the Robertson device, still, at the end where the last remaining material must be expelled, one would still have to use his fingers to accomplish the job. Accordingly, in each of the foregoing devices where an attempt has been made to minimize manipulation of the tube and to provide an automatic, attractive, economical device, both economy and mechanical operation have been frustrated by the inability to dispense the last remaining material in the tube by automatic means.

The present invention provides a dispensing holder for a collapsible tube which does not suffer the foregoing drawbacks; rather, it is constructed in such a way as to facilitate emptying of the last remaining material in the tube. More specifically, the present invention provides a dispensing holder for a collapsible tube, the holder comprising a carrier and seat in the form of a plate wall. The carrier is formed to receive a collapsible tube of the type having a relatively flat rear end and a conical front end terminating in a rigid neck. The seal extends substantially normal to the front of the carrier and the carrier is formed with recessed front portion connected to the seat. In accordance with this invention, critical to facilitating emptying of the tube, the seat and carrier define a continous aperture extending across their connection and formed so that the conical front end of the collapsible tube can be received through the seat and then pivoted downwardly through the connection to be received in the recess and through the carrier plate. Means are provided for progressively collapsing the tube to a position adjacent the aperture through the carrier whereby to permit the conical end of the collapsible tube to be pivoted downwardly, thereby facilitating emptying of the tube.

In further detail, the carrier comprises a plate formed with elongated side edges and defines a channel between the edges as an elongate concave surface, to receive the collapsible tube. The seat extends upwardly past the plane of the side edges of the carrier plate. The means for progressively collapsing the tube comprises a slidable compressor which preferably has a rounded leading edge. The compressor includes a central lower portion convexly shaped to conform to the concave surface of the carrier plate and which includes edge portions which are turned in to slidably engage the side edges of the carrier plate and support the lower portion of the compressor spaced from the carrier plate a distance sufficient for insertion of the flat end of the collapsible tube, e.g. in the range of about 1/32 inch to $\frac{1}{4}$ inch.

The result is a dispensing holder for a toothpaste tube or the like which progressively empties the contents of the tube by simple finger grip movement of a slidable compressor and which, when the tube has been compressed to be almost empty, allows the neck of the tube to be pivoted downwardly to enable further emptying of its contents by further movement of the slidable compressor.

DETAILED DESCRIPTION

Figure 1:
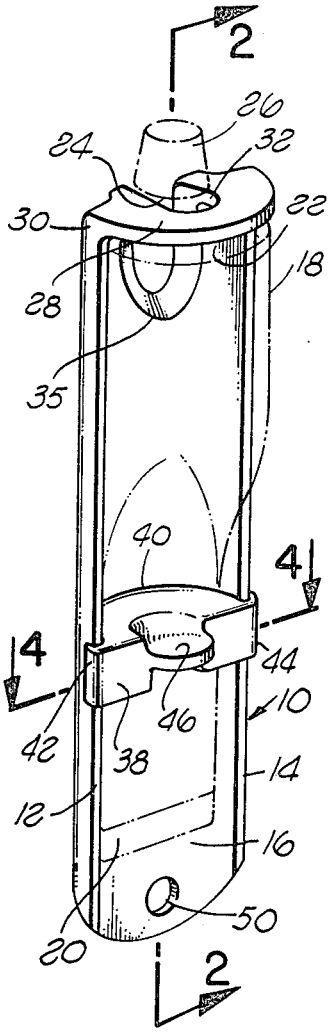
FIG. 1 is a perspective view of the dispensing holder of the present invention shown with a collapsible tube therein illustrated in shadow.
Figure 2:
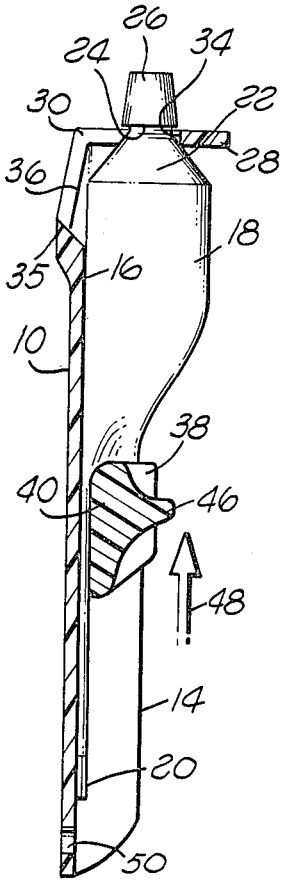
FIG. 2 is a cross-sectional view of the dispenser and holder of FIG. 1 taken on line 2—2 of FIG. 1 in the direction of the arrows, with the front end of the toothpaste tube shown in elevational view.

Referring to FIGS. 1 and 2, in the embodiment of the invention illustrated by the drawings, the dispensing holder consists of a carrier plate 10 formed with elongate side edges 12 and 14 and with an elongate concave surface 16 between the edges 12 and 14. The plate defines a channel formed to receive a collapsible tube 18, such as a toothpaste tube, of the type having a relatively flat rear end 20 and a conical front end 22 terminating in a rigid neck 24. The rigid neck 24 can be formed with threads on which is placed a cap 26 to seal the contents of the tube when the dispensing holder is not in use.

The holder includes a seat 28 in the form of a wall which is connected to the front of the carrier plate 10 and which in this illustration is integral therewith, at the connection 30. The seat 28 extends substantially normal to and past the plane of the side edges 12 and 14 of the carrier plate 10. The distance that the seat 28 extends is at least sufficient so that an aperture 32 formed therethrough can have its upper edge 34 high enough to permit receipt through the aperture of the rigid neck 24 of the tube 18.

The carrier plate is formed with a recessed portion 35 at the connection 30 which, in turn, is formed with an aperture 36 which joins with the seat aperture 32 through the seat 28 so as to form a continuous, L-shaped aperture. The distance 37 (FIG. 3) between the seat 28 and the rearmost edge of the aperture 36 is substantially less than the diameter of the conical front end 22 of the tube 18.

Figure 4:
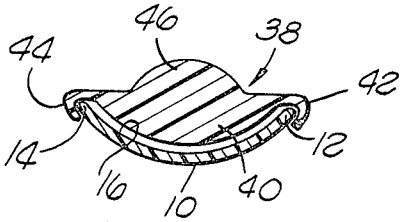
FIG. 4 is a cross-sectional view taken on line 4—4 of FIG. 1, in the direction of the arrows.

Referring additionally to FIG. 4, a slidable compressor 38 is provided which comprises a central lower portion 40 convexly shaped to conform to the concave surface 16 of the carrier plate 10. The compressor 38 also includes edge portions 42 and 44 which are turned in to slidably engage the side edges 12 and 14, respectively, of the carrier plate 10. The compressor 38 is formed with an upper lug portion 46 for facilitating finger-gripping of the compressor. The compressor 38 is supported so that the bottom surface of its lower portion 40 is spaced from the upper surface 16 of the carrier plate 10 a distance sufficient for insertion of the flat rear end 20 of the collapsible tube 18.

In operation, one places the collapsible tube 18 on the carrier plate 10 so that its rigid neck 24 extends through the opening 32 in the seat 28. The compressor 38 is then slid onto the carrier plate 10 by engaging the turned-in side edges 42 and 44 with the respective side edges 12 and 14 of the carrier plate and by moving the compressor with a forward motion over the flat tube end 20. FIG. 1 illustrates the configuration after a substantial portion of the contents of the tube 18 have been removed by forward movement of the compressor 38, such movement being shown by the arrow 48 in FIG. 2.

Figure 3:
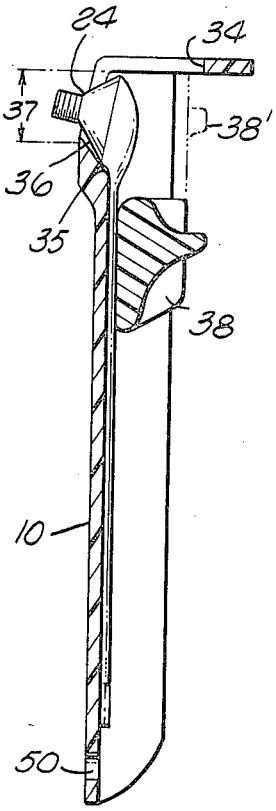
FIG. 3 is a view similar to that of FIG. 2 but in a later stage of operation.

Referring to FIG. 3, as the slidable compressor 38 is moved to a position adjacent the recessed carrier plate portion 35 and the aperture 36 therethrough, one can simply flip the neck 24 of the collapsible tube so that the conical front end of the collapsible tube pivots downwardly into the recess portion 35 with the tube neck extending through the aperture 36. The compressor 38 can then be moved further forward, as shown in shadow at 38', to substantially empty the contents of the tube.

Both the carrier plate 10 and slidable compressor can be formed of organic plastic material, for example polystyrene. As a consequence, an inexpensive, attractive and high efficient dispensor device is provided. The rear end of the carrier plate 10 can be formed with an aperture 50 to facilitate securing the carrier plate 10 to a wall with the mouth of the collapsible tube facing downwardly.

I claim:

1. A dispensing holder for a collapsible tube, said holder comprising:

a carrier formed to receive a collapsible tube of the type having a relatively flat rear end and a conical front end and terminating in a rigid neck;

a seat extending substantially normal to, the front of said carrier;

said carrier being formed with a recessed front portion connected to said seat whereby said seat and carrier define a continuous aperture at least a continuous portion of which is at least as wide as the neck of a collapsible tube of said type and extends across the connection between said seat and carrier so that the conical front end of the tube of said type can be received through said seat and then pivoted downwardly through said connection to be received in said recess and through said carrier; and means for progressively collapsing a collapsible tube that may be disposed on said carrier to a position adjacent said aperture through said carrier whereby to permit the conical front end of a collapsible tube of said type to be pivoted downwardly through said connection thereby facilitating emptying of said tube.

2. The holder of claim 1 in which said aperture is L-shaped.

3. The holder of claim 1 in which said carrier is formed with elongate side edges and defines a channel between said edges to receive said collapsible tube.

4. The holder of claim 3 in which said carrier comprises a plate defining said channel as an elongate concave surface between said edges.

5. The holder of any of claims 1–4 in which said means for progressively collapsing a collapsible tube comprises a compressor and means for slidably connecting said compressor to said carrier spaced from said carrier a distance sufficient for insertion of the flat rear end of a collapsible tube of said type between said compressor and said carrier plate.

6. The holder of claim 3 or 4 in which said means for progressively collapsing a collapsible tube comprises a slidable compressor, said compressor comprising a lower portion shaped to conform to said carrier and comprising edge portions formed to slidably engage the side edges of said carrier and support said lower portions spaced from said carrier a distance sufficient for insertion of the flat rear end of a compressible tube of said type between said compressor and said carrier.

7. The holder of claim 4 in which said means for progressively collapsing a collapsible tube comprises a slidable compressor, said compressor comprising a central lower portion convexly shaped to conform to the concave surface of said carrier plate and comprising edge portions formed to slidably engage the side edges of said carrier plate and support said lower portion spaced from said carrier plate a distance sufficient for insertion of the flat end of a collapsible end of said type between said compressor and said carrier plate surface.

8. The holder of claim 1 in which the distance between said seat and the rearmost part of said aperture is substantially less than the diameter of the conical front of said tube.

9. A dispensing holder for a collapsible tube, said holder comprising:

a carrier plate formed with elongate side edges and with an elongate concave surface between said edges, defining a channel formed to receive a collapsible tube of the type having a relatively flat rear end and a conical front end terminating in a rigid neck;

a seat extending substantially normal and past the plans of the side edges of said carrier plate;

said carrier plate being formed with a recessed front portion integrally connected with said seat whereby said seat and carrier plate define a continuous L-shaped aperture at least a continuous portion of which is at least as wide as the neck of a collapsible tube of said type and extends across the connection between said seat and carrier so that the conical front end of the tube of said type can be received through said seat and then pivoted downwardly through said connection to be received in said recess and through said carrier plate; and a slidable compressor comprising a central lower portion convexly shaped to conform to the concave surface of said carrier plate, and comprising edge portions formed to slidably engage the side edges of said carrier plate and support said lower portion spaced from said carrier plate a distance sufficient for insertion of the relatively flat rear end of a collapsible tube of said type between said compressor and said carrier plate surface whereby movement of said compressor along said carrier plate serves to progressively collapse a collapsible tube that may be disposed between said compressor and said carrier plate and whereby movement of said compressor to a position adjacent said aperture through said carrier plate permits the conical front end of a collapsible tube of said type to be pivoted downwardly through said connection thereby facilitating emptying of said tube.

10. The holder of claim 7 or 9 in which said compressor is formed with an upper lug portion for facilitating finger-gripping of said compressor.

11. The holder of claim 7 or 9 in which the edge portions of said compressor are turned in to slidably engage the side edge of said carrier plate.

12. The holder of claim 7 or 9 in which said distance is in the range of about 1/32 inch to ¼ inch.

13. The holder of any of claims 1–4, 7, 9 or 8 in which the leading edge of said compressor is rounded.

* * * * *

UNITED STATES PATENT AND TRADEMARK OFFICE

CERTIFICATE OF CORRECTION

PATENT NO. : 4,270,672

DATED : 6/2/81

INVENTOR(S) : Ralph Kraals

It is certified that error appears in the above-identified patent and that said Letters Patent are hereby corrected as shown below:

Column 4, line 59, delete "plans of the" and substitute --plane of the--.

Signed and Sealed this

*First* Day of *December 1981*

[SEAL]

*Attest:*

GERALD J. MOSSINGHOFF

*Attesting Officer*

*Commissioner of Patents and Trademarks*